US006933903B2

(12) United States Patent
Petersson

(10) Patent No.: US 6,933,903 B2
(45) Date of Patent: Aug. 23, 2005

(54) RECEIVING SIGNALS FROM PLURAL SATELLITES IN ONE ANTENNA

(76) Inventor: Stig Anders Petersson, V. Hökmark 84, Lövånger (SE), SE-93010

( * ) Notice: Subject to any disclaimer, the term of this patent is extended or adjusted under 35 U.S.C. 154(b) by 0 days.

(21) Appl. No.: 10/471,081

(22) PCT Filed: Mar. 8, 2002

(86) PCT No.: PCT/SE02/00426

§ 371 (c)(1),
(2), (4) Date: Mar. 23, 2004

(87) PCT Pub. No.: WO02/071545

PCT Pub. Date: Sep. 12, 2002

(65) Prior Publication Data

US 2004/0155830 A1 Aug. 12, 2004

(30) Foreign Application Priority Data

Mar. 8, 2001 (SE) ..... 0100799

(51) Int. Cl.[7] ..... H01Q 13/00

(52) U.S. Cl. ..... 343/779; 343/775

(58) Field of Search ..... 343/775, 776, 343/779, 757, 878, 880, 882

(56) References Cited

U.S. PATENT DOCUMENTS 6,052,099 A * 4/2000 Imaizumi et al. ..... 343/840
6,313,808 B1 * 11/2001 Yuanzhu ..... 343/786

FOREIGN PATENT DOCUMENTS

| | | |
|---|---|---|
| DE | 4446084 | 7/1996 |
| FR | 2701337 | 8/1994 |
| FR | 2724058 | 3/1996 |
| FR | 2746966 | 10/1997 |
| FR | 2786321 | 5/2000 |
| WO | 92/07394 | 4/1992 |

* cited by examiner

*Primary Examiner*—Hoang V. Nguyen
(74) *Attorney, Agent, or Firm*—Nixon & Vanderhye P.C.

(57) ABSTRACT

A device for receiving/transmitting electromagnetic signals from/to at least two satellites fixedly located at points at the geostationary path comprises an antenna, for example a lens (1) of waveguide nature. The antenna images remote points at a focal surface and in the points where the satellites are imaged receiver horns (23, 23') are placed. The horns are adjustably mounted to a rail (21) of a mounting unit (9) except the central horn (23') that is fixedly placed for receiving along the optical axis of the antenna, at a predetermined distance of the antenna. The rail is mounted to be rotated about the optical axis of the antenna, this giving a simple adjustment of the other horns (23). Using an adjusting assembly the curvature of the rail can be varied to be adapted to receiving at different latitudes.

17 Claims, 5 Drawing Sheets

RECEIVING SIGNALS FROM PLURAL SATELLITES IN ONE ANTENNA

This application is the U.S. national phase of international application PCT/SE02/00426 filed 08 Mar. 2002, which designated the U.S.

TECHNICAL FIELD

The present invention relates to a device for receiving/transmitting signals from/to a plurality of geostationary satellites using a single antenna and in particular a holder for microwave horns to be used for antennas such as lens antennas and paraboloid antennas for receiving signals from a plurality of satellites.

BACKGROUND OF THE INVENTION

Today a number of satellites 101 are fixedly placed on the so called geostationary path 103, see FIG. 10. Such a satellite is located on a principally fixed point above the earth surface 105, straight above a fixed point on the equator 107. These satellites send among other things TV-signals that are intended for private homes, company premises or apartments and that are usually received by paraboloid antennas placed in the direct vicinity of the place where the signal is to used for displaying television.

Paraboloid antennas intended for receiving microwave signals exist today that are arranged for simultaneously receiving signals from several satellites in the same antenna, for example the so called "space ear" which is constructed as a paraboloid mirror vertically and a circular mirror horizontally.

When one tries to capture satellite signals using a reflecting antenna, i.e. a paraboloid antenna, in a point somewhere on the earth surface, located apart from the equator, the signal sources are imaged according to optical laws that for microwaves are very complicated. Consequently a receiving device arranged for simultaneously receiving from satellites in the same antenna today has only movable receiver heads that can be individually adjusted.

Instructions on the way in which these adjustments are to be made usually accompany commercially available paraboloid antennas when buying them and they contain a number of complicated graphs and angle tables that the buyer must refer to the longitude and latitude at the place where the antenna is to be installed. Thereafter the system can be mounted by a careful setting-up according to the values of the adjustment angles obtained from these tables and graphs. Normally each receiver horn used is individually adjustable in all directions.

This fact has appeared to be unfavourable for the seller of these systems since the buyer most often cannot easily find the correct angles for receiving from each individual satellite. Few buyers succeed in making all steps in the mounting operation without assistance from well instructed persons and a number of auxiliaries for the mounting, such as signal strength indicator, compass, plummet, etc.

After one of the receiver horns has been adjusted as to its direction, it is also as a rule required that when the second horn is to be adjusted also the whole antenna must be readjusted, so that the first horn must be again adjusted and so on. The installation operation thus comprises iterative steps that certainly result in a better and better solution but is time consuming. According to the state of the art today no simple and universal method exists for easily installing an antenna for multifocus receiving, i.e. for receiving signals from different source in the same antenna.

An antenna, that refracts or images electromagnetic waves from a source having the shape of point creates a focus that is the point in which the focused signal is strongest. Also signals that arrive obliquely in relation to the optical axis of the antenna are strongly focused in a point. For antennas that are particularly designed to focus also electromagnetic wave arriving obliquely towards the antenna this effect is still more evident.

If these foci are derived for waves in directions of a large number of angles in relation to the optical axis of the antenna points are obtained forming a surface in which naturally also the focus for waves arriving along the optical axis are located. This focus surface has a shape determined by the characteristics of the antenna. For example a rotationally symmetric antenna has a rotationally symmetric focus surface about its symmetry axis that at the same time is the optical axis. For example it is for a paraboloid or an offset paraboloid antenna the axis around which the paraboloid surface is designed, i.e. is constructed around, and the focus surface has as a rule some type of cup shape.

For example a lens of waveguide character can be designed so that foci in different angles through the lens for remote signal sources form a spherical focus surface having a radius equal to the focus distance or as another extreme in a flat focus surface. One can say that the image forms a focus surface having a radius of curvature designed to have some length that is shorter than the focus distance up to and including an infinite radius and that by definition intersects the focus which is traditionally defined along the optical axis of the lens, i.e. that obtained for waves incoming alone the optical axis or from waves incoming from a source located on the optical axis.

For the rotationally symmetric lens antenna according to the published International patent application WO 94/11920 A1 or an optical photographic lens of glass the focus points form a flat surface that is rotationally symmetric in relation to the symmetry axis which at the same time is the optical axis. When imaging the geostationary path using such a lens antenna in the focus plane for such a lens a substantially straight, sometimes a little curved line, can be obtained.

Other antennas that are not rotationally symmetric have as a rule more or less an approximate rotation symmetry about the optical axis.

SUMMARY OF THE INVENTION

It is an object of the invention to facilitate the adjustment operation when installing an antenna for receiving a plurality of satellite signals.

It is generally an object of the invention to provide a receiver device for signals from satellites that, using a simple mechanical readjustment, can simultaneously receive signals from at least two satellites.

Thus generally, a device for receiving/transmitting electromagnetic signals from/to at least two satellites which are fixedly located in points on the geostationary path comprises an antenna of some kind, for example a paraboloid antenna or a lens of waveguide character or a lens antenna of for example the type disclosed in the International patent application cited above. The lens can be constructed to image distant source points on a primarily rotationally symmetric focus surface so that the portion of the geostationary path within which the satellites are located are imaged on a curve on the focus surface. Furthermore the device comprises a plurality of microwave horns, one microwave horn for receiving/transmitting from/to each satellite, the microwave horns being placed on suitable positions along the focus curve.

The antenna is thus designed to give an image of at least two satellites, which are visible within a geographic region, in a plane parallel to the geostationary path. Further, a holder including a rail is provided along which the horns are slidingly adjustable except the central horn that is always placed at the centre of the rail and in the optical axis of the antenna. An adjustment device for mounting the at least two microwave horns can be provided. When adjusting it, the shape of the rail and also the mutual distance of the horns can be changed.

Generally thus, the rail is mounted to rotate at the antenna, using a suitable rotatable holder, so that it can adopt an adjustable angular position about an axis, suitably the axis of the antenna, that can be a symmetry axis, or also generally an axis of a focus surface of the antenna. The movement of the rail in the adjustment operation is in a plane perpendicular to the axis. The rail comprises a fixed position for that of the microwave horns which has its receiving direction aligned with the axis. The term "rail" can here generally be taken to mean some part along which the horns can be adjustably displaced and e.g. comprise a metal piece having holes configured in different ways, so that the horns can be secured to the rail by securing elements extending through the holes.

BRIEF DESCRIPTION OF THE DRAWINGS

The invention will now be described as a non-limiting embodiment with reference to the accompanying drawings in which.

DESCRIPTION OF A PREFERRED EMBODIMENT

Figure 10:
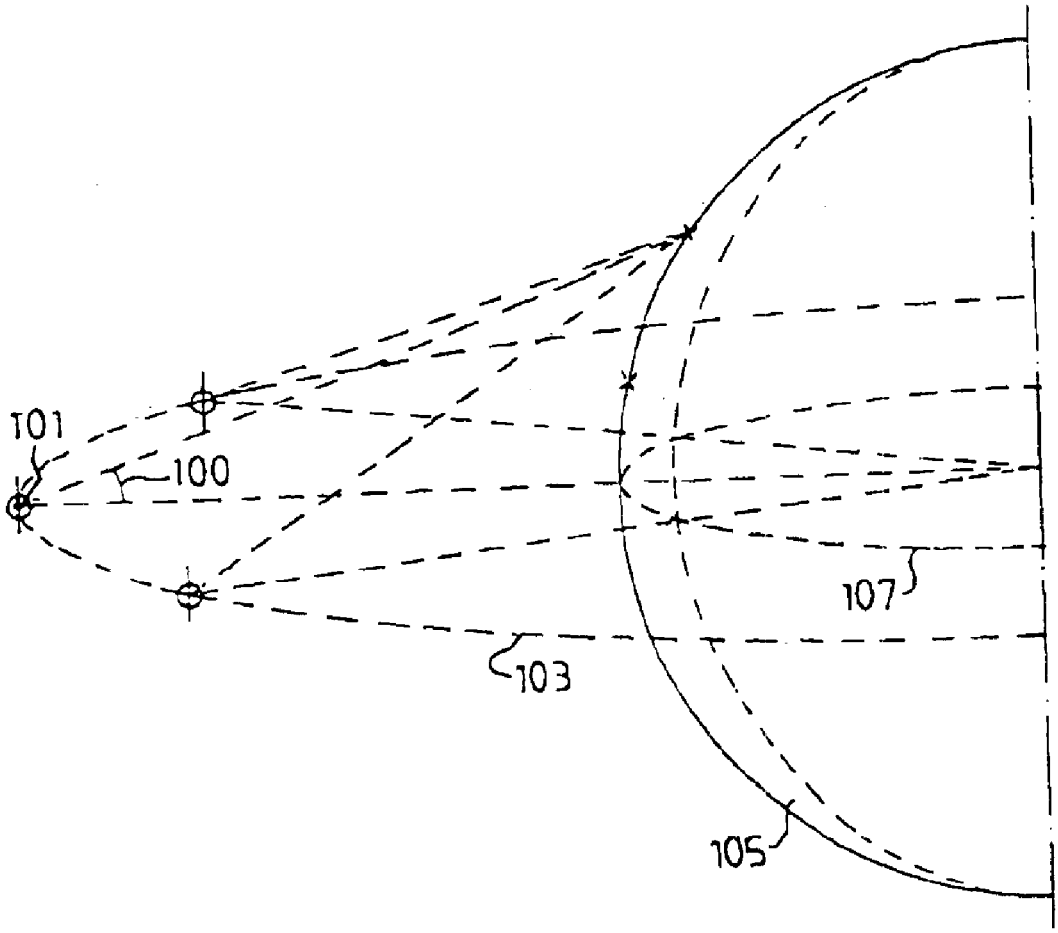
FIG. 10 is a schematic perspective view illustrating receiving signals in a point from several satellites.

Satellites 101 for for example television transmission are fixedly placed on the geostationary path 103, see FIG. 10, i.e. these satellites are located in substantially fixed positions above the earth surface 105, straight above fixed points on the equator 107. The inclination angle 100 that is here defined as the angle in relation to a plane through the equator, for a small section of the geostationary path located straightly in the southern or northern direction or for a geostationary satellite located there varies for a viewer located on the earth surface from 0° when looking from the equator (no slope) to 8.5° at the poles, see FIG. 10. For a viewer staying in a region having a smaller geographic extension, say in a region located between 40° latitude and 70° latitude, the inclination has a value between 4° and 7°.

The television signals are usually received by a paraboloid antenna placed in the direct vicinity of the place where the signal is to used for displaying television. Using the same paraboloid antenna signals from several satellites can be simultaneously received and it then usually has movable receiver heads, the receiving directions and positions of which can be individually set. In the case where television signals are received by a paraboloid antenna which is a reflecting antenna, the signal sources are imaged according to optical laws which for the microwaves used for the television signals are very complicated. In particular the image of a section of the geostationary path located in the straight southern direction can be considered within which several satellites are located. It is generally true that the greater the inclination of the section of the path is as seen from a place on the earth surface. the more curved is the image thereof in the focus plane of an antenna installed in this position, since a viewer in this position sees more of the curved character of the section of the path. The magnitude of the curvature is determined by the specific design and dimensioning of the antenna. For a limited section of the path for an angular region of for example 20°, when imaging the section of the path in a lens antenna that can be used instead of a paraboloid antenna, the deflection is about 6 mm for maximum latitude and inclination.

For receiver horns placed along a straight line this deviation means small losses since the receiving lob that an antenna of a normal size today has is nearly flat in this region. The receiver horns can then be placed along a curved line located between the curved tiles obtained at the most southern and northern points of the region.

In the case where the angular range of the section of the path is larger that 20° or where the antenna magnifies the curvature too much, it can be necessary to use other solutions such as for example existing optical auxiliary lenses or mirrors or the most common—to use flexibility in the mounting points of the devices holding the receiver horns.

The angular distance between two satellites varies as seen from a point on the earth surface when the latitude of this point is changed, due to the fact that the earth is round and that thereby there are different distances a point on the earth surface to the section of the path, the ends of which are defined by the satellites. For a region, for example Europe, that as in the example above extends from 70° latitude to 40° latitude, the angle between two satellites located 20° from each other as seen from a point located in a most northern position, i.e. at the latitude 70°. is about 22° at 40° latitude. The imaging—interval becomes larger the closer to the point on the earth surface the satellites are located, i.e. to the place where the antenna is located. This results in that the images obtained by an antenna of the satellites on the focus line are also displaced so that they obtain different distances of each other when the antenna is placed at different latitudes.

Receiver horns arranged along a straight line are therefore most often adjustably mounted in the case where the signal sources the signals of which are to be received produce rays as seen from the optical centre of the antenna have an angular interval larger than 6°. The individual horns must be somewhat displaced to become more distant of each other for a location of the antenna closer to the equator and somewhat closer to each other for a location of the antenna further away from the equator. In addition, receiver horns are conventionally attached to some holders and each have a special cable connected to some central electronic unit in which waveguides and amplifying electronic circuits are arranged. The straight line, alone which the horns are mounted, is advantageously adjustably arranged, so that the receiver horns can be made to be located in suitable positions. Such a construction will now be described.

Figure 1:
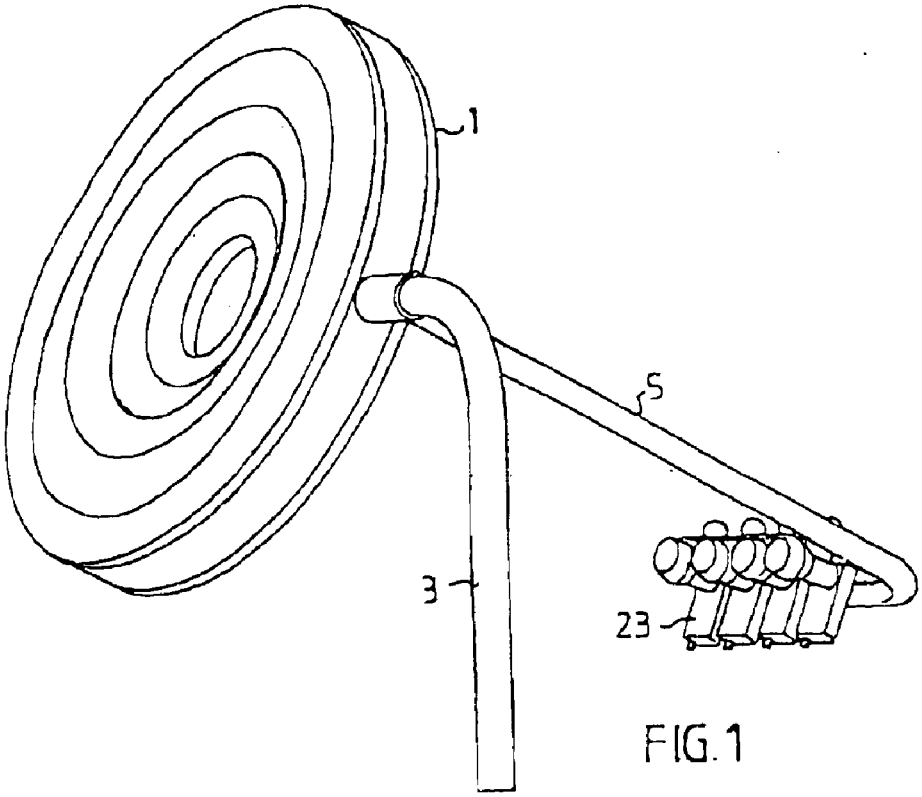
FIG. 1 is a perspective view of a lens antenna.
Figure 2:
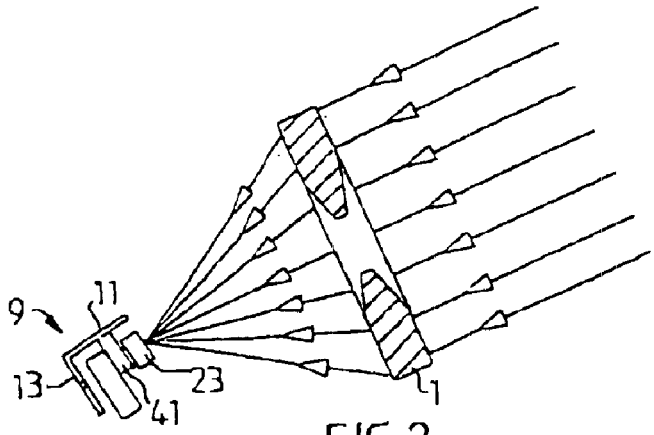
FIG. 2 is a cross-sectional view of the lens antenna of FIG. 1.
Figure 3:
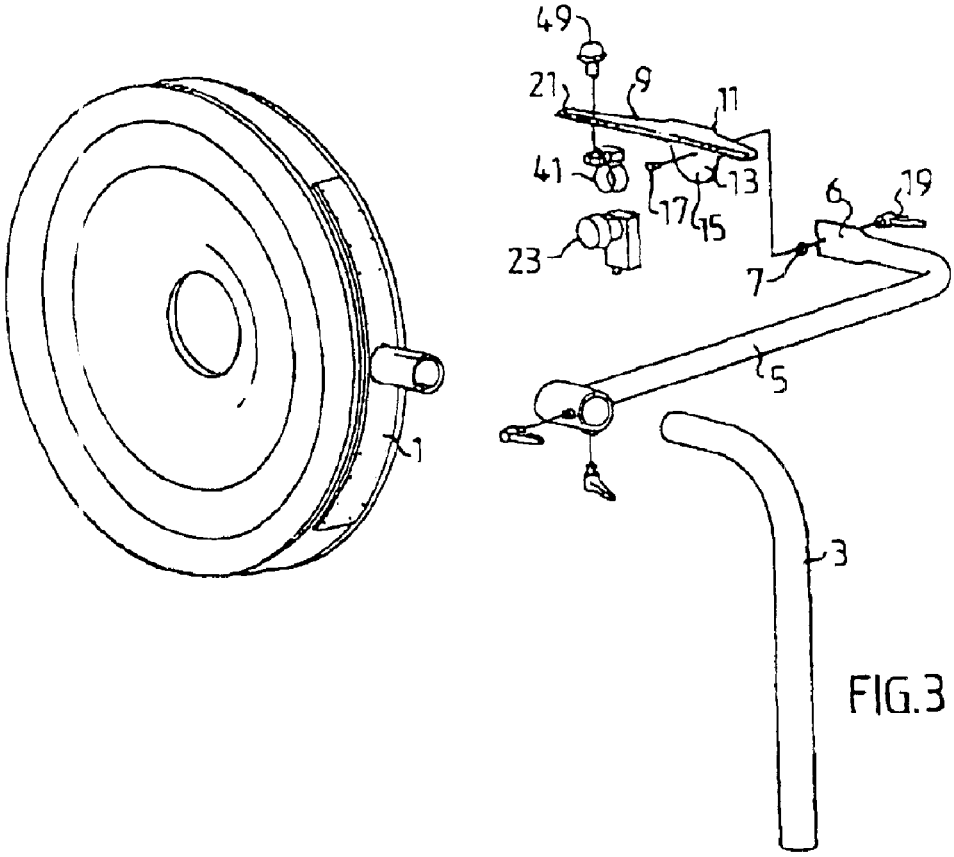
FIG. 3 is an assembling view of the lens antenna of FIG. 1.

A receiver device comprising a lens antenna 1 is shown in a perspective view in FIG. 1 and in a section through the optical axis in FIG. 2. The lens antenna 1 has the shape of a substantially circular plate having a symmetry axis perpendicular to a plane through the plate, see the International patent application cited above, and is at a place at its edge rotatably mounted to a curved rod 3 which in turn is attached to some base structure, for example a roof or a wall of a building. From the attachment point of the rod 3 at the antenna an arm 5 extends that at its free end has an inner or outer mounting surface 6 located parallel to the plane through the antenna 1. The arm 5 is in the design shown curved to extend with its outer-most portion parallel to the antenna 1, i.e. perpendicularly to the antenna axis, when the arm has the intended position shown, so that its outer-most portion extends through the axis. The arm 5 has at its free end a hole 7 for mounting a horn holder 9, see the assembling view of FIG. 3, so that the surface 6 together with the hole 7 and corresponding parts of the horn holder 9 and u securing element together form a rotatable holder. The axis of the hole 7 advantageously agrees with the axis of the antenna 1 the rotatable holder thereby obtaining a rotational axis located along the axis of the antenna.

The horn holder 9 is made substantially from a bent metal plate detail and comprises a horn securing part 11 having approximately the shape of a low, isosceles triangle having a long side and a point with a obtuse angle opposite the long side. Furthermore, the horn holder comprises an arm securing part 13, consisting of a tongue, that projects in an angle, e.g. of about 90°, from the horn securing part 11, from the obtuse point thereof. The arm securing part has a mounting hole 15 for mounting to the arm 5 by means of for example a screw 17 together with a cooperating nut 19 provided with a handle.

Figure 4:
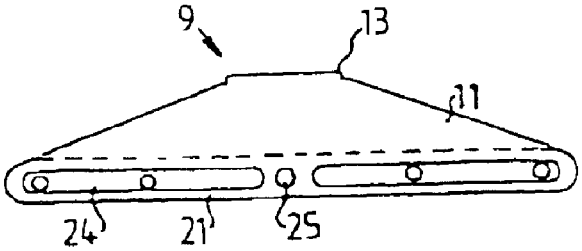
FIG. 4 is a view of a holder for a plurality of microwave horns.
Figure 5:
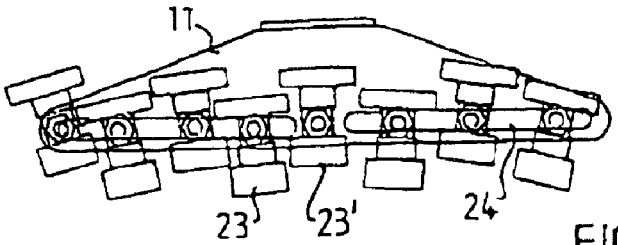
FIG. 5 is a view similar to FIG. 4 including mounted microwave horns.

The horn securing part 11 carries at or more particularly continues at its long side in a part 21 which is herein called a rail and at which the horns 23 are mounted, see view from above in FIGS. 4 and 5. The rail is in the design shown only the outer part of the horn securing part facing the antenna 1. The rail 21 has longitudinal holes 24 at its ends and a hole 25 in its central part, between the two longitudinal holes. The longitudinal holes are in this embodiment straight and are located aligned along a straight line, on which also the centre hole is located, i.e. the holes 24 have coinciding longitudinal axes intersected by the axis of the centre hole 25. Generally however, the axes of the holes 24 and the centre of the centre hole 25 can be located along a curved line, see the description below. The horns 23 are mounted to the rail 21 by means of mounting parts 41, so that the optical axes of the horns are located below the horn securing part 11. The mounting parts allow securing at selectable positions on the rail 21. However, the central horn 23' is centrally secured, at the central hole 25 of the rail, and this hole has such a shape that the central horn cannot be laterally displaced but obtains a fixed position on the rail.

Figure 11:
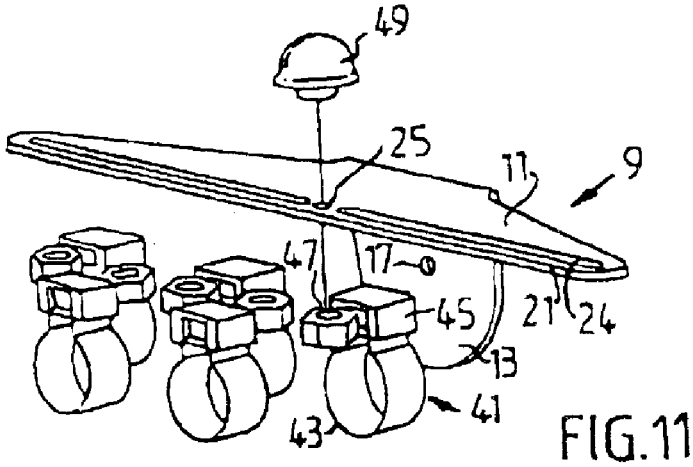
FIG. 11 is a perspective view of horn holders to be attached to a rail.

The mounting of the individual horns 23, 23' to the rail 21 is seen in the perspective view of FIG. 11 The horns are mounted in holders 41 including a low round bent part 43 for securing the intermediate portions of the horns. The bent parts 45 project downwards from holder blocks 45 having holes 47, which for example are threaded. The holders are mounted to the rail 21 in the elongated holes 24 thereof or to the centre hole 25 respectively by means of for example screws, one screw shown at 49, cooperating with the holes 47. The holder blocks 45 are more narrow, as seen in the direction of the rail 21 than the width of the bent parts and the horns in the same direction and the centre line or axis of the holes 47 is located at some distance of the bent parts 43. This results in that if the holder blocks are placed with their holes 47 alternatingly with each other on each side of a centre plane through the rail, the holder blocks can if required be placed closely at each other, the bent parts and the horns thus being alternatingly located on different sides of said centre plane. The axes of the horns 23, 23' for receiving can thereby be placed more closely to each other that what would be the case if all horns were placed directly at the sides of each other.

Adjusting the direction of the lens antenna 1 and the receiver horns 23, 23' will now be described. As is conventional, first the antenna 1 is adjusted by rotating it to the desired position about two axes so that a rotation about the first axis sets the elevation of the antenna and a rotation about the second axis sets the horizontal direction of the antenna. Such a correctly made adjustment of directions results in that the satellite signals are focused on points on a focus line located in the focus surface.

In the case where the focus surface is flat what is true for the lens antenna according to the International patent application cited above, the focus line on which the point-shaped images of the satellites is a straight line. The receiver horns 23, 23' are then to be placed along a straight line what is obtained using a straight rail 21 that in turn is to be placed in a correct angular position about the optical axis of the antenna. The adjustment of direction can then be made by first assuming that the arm 5 is placed in such a rotational angle that the centre horn 23' is located centered for receiving along the optical axis of the antenna. Then the direction adjustment of the whole antenna 1 about said two axes is performed, the optimum position determined as the position at which the centre horn provides a maximum signal for a selected satellite, and the antenna can then be locked in the found position. Thereafter the horn holder 9 is rotated about the rotatable joint or rotary mounting part formed by the connection at the holes 7 and 15, and simultaneously a horn 23 at the side of die centre horn is displaced along the rail 21 to a position that allows receiving signals from another satellite. The axis of the hinge or the rotary mounting part is then located also along the optical axis of the antenna. The signal to this horn is then determined and evaluated all the time and the horn holder and the horn are locked in the positions which provide a maximum signal. Thereafter the remaining horns located at the sides can be displaced along the rail and be locked in the positions at which they provide maximum signals for other selected satellites.

Figure 8A:
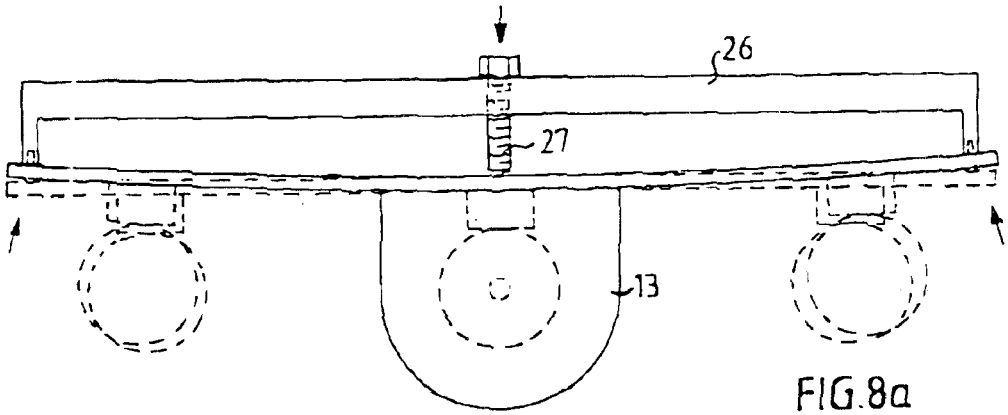
FIGS. 8*a*, 8*b* are views from the front and from above of a flexible holder for microwave horns.
Figure 8B:
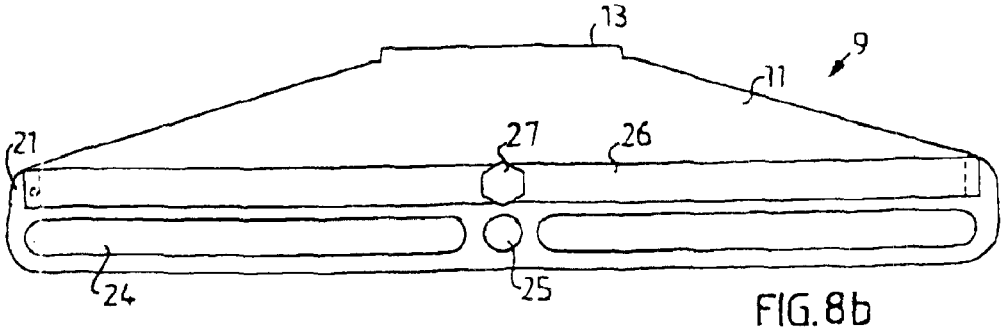

However, the focus line on which a section of the geostationary path is imaged is not totally straight since the section of the path is not located along a straight line or appears as a straight line seen from points distant from the equator. Therefore, it can many times be necessary to somewhat bend the rail 21 along which the horns 23 are mounted and thereby the line along which the longitudinal axis of the elongated holes 24 and the centre holes 25 is located, for example to manually deform the rail plastically to a permanently curved shape. A device for producing such a bending in the case where the rail is made from elastic material can comprise a stiff balk 26 that extends in parallel to the flexible rail 21, retains or is attached to the rail at the ends thereof and is provided with an adjustment screw 27 at its centre, see FIGS. 8*a*, 8*b*. Another embodiment can include a tensioning element, not shown, acting between the ends of the rail to work with a compressing force so that the rail can bend like a stringed bow, compare the description of FIG. 9 below. The bending of the rail is then to be made before beginning the adjustment procedure described above. A suitable deflection can be obtained for example from tables or by a template valid for the latitude at which the antenna is installed.

Figure 6:
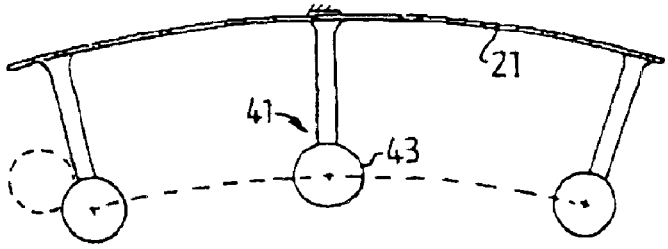
FIGS. 6 and 7 are schematic views of microwave horns mounted on a flexible rail allowing bending in different directions.
Figure 7:
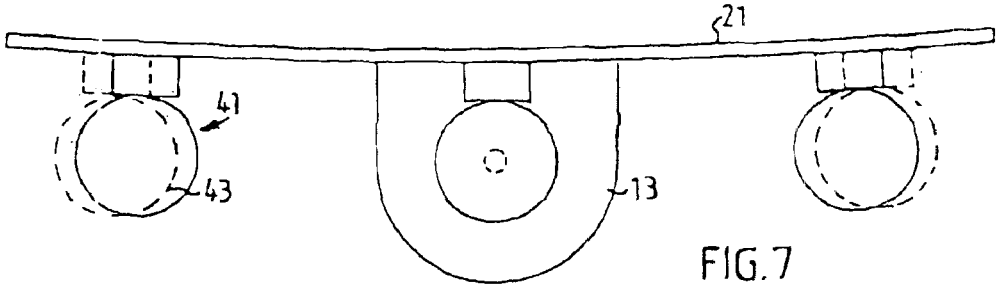

By the fact that the axes of the receiver horns are placed at a distance of the rail 21, also the horns are move closer to each other when bending the rail, see FIG. 6, or farther away from each other, see FIG. 7, depending on the side to which the bending is made.

Since both the bending of the rail at which the horns are mounted and the mutual distance between the horns are dependent on the latitude, at which the antenna is installed, a relation therebetween exists that is determined only by the latitude. Therefor a device can be used that simultaneously changes both bending and distance.

Figure 9A:
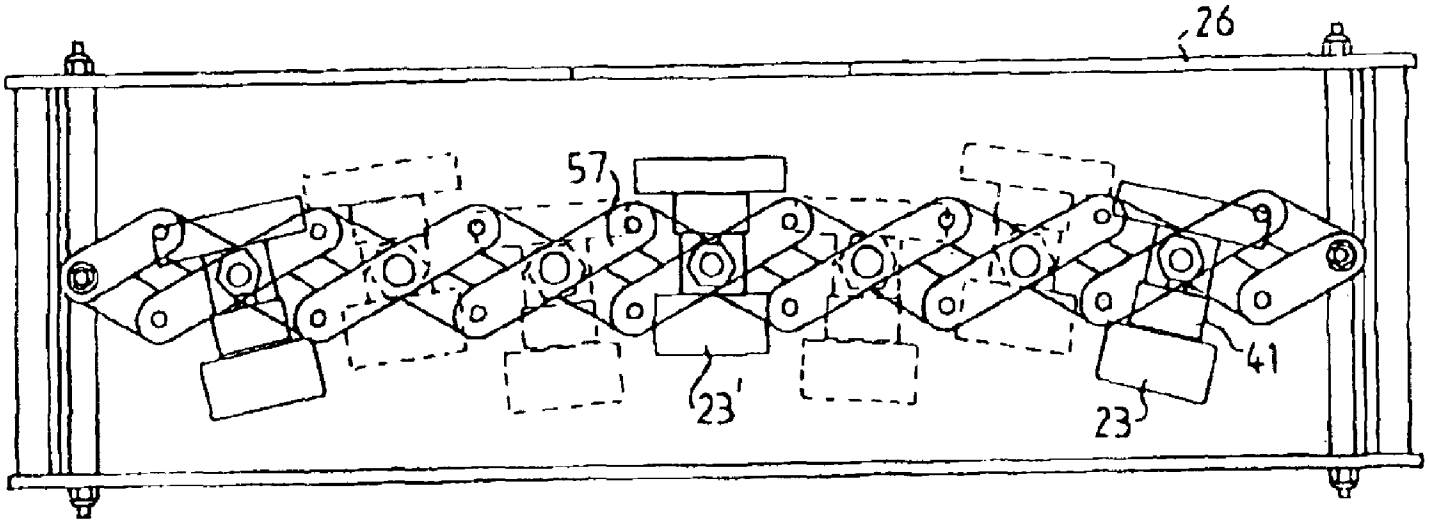
FIGS. 9*a*, 9*b* are views from the front and from above of a flexible holder including an adjustment device of pantographic type for microwave horns.
Figure 9B:
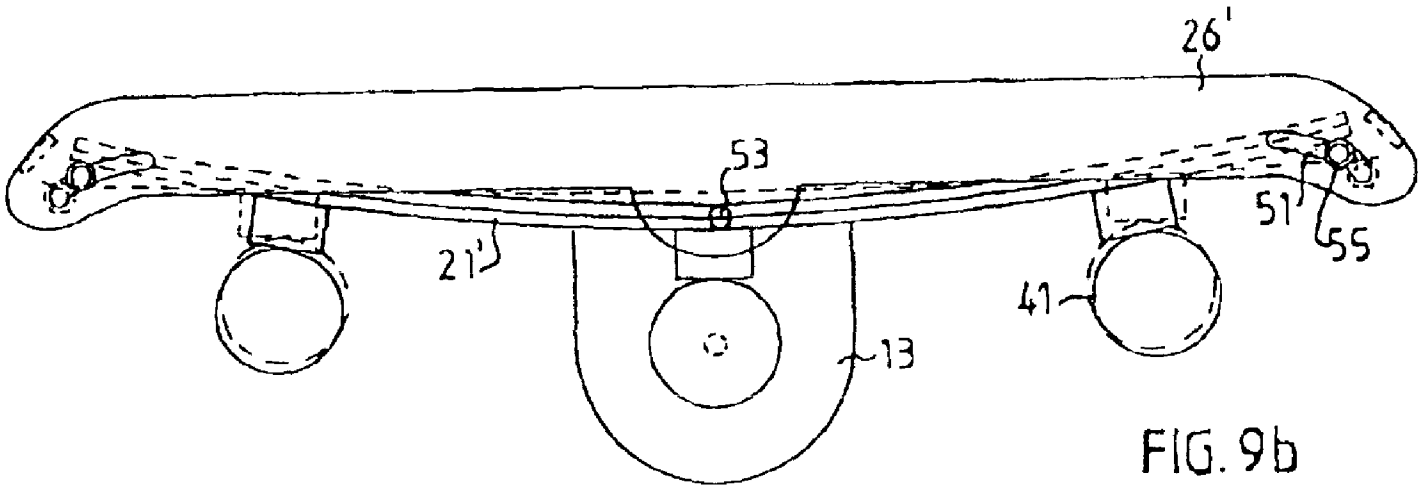

Such a more complicated device can thus be used to obtain a controlled displacement of the positions of the horns when bending the rail, see FIGS. 9*a*, 9*b*. At the two sides of the rail 21', directed from and towards the antenna, two identical stiff bars 26' having elongated grooves 51 at their two ends are provided. The shape of the grooves is determined by the character of the antenna and can be straight or have an elliptical shape. At the centres of the bars holes 53 are provided, in which projections on the rail 21' pass so that the rail at its centre is mounted to move at the bars. In the grooves 51 other pins 55 are provided resting against the opposite flat side of the rail, at the ends of the rail. The bending of the rail 21 is produced by displacing the pins in the grooves. The shape of the grooves determines the shape of the bent rail that for example also can be elliptical. At the same time when such a displacement is made a pantographic device 57 is operated which is located at one of the large surfaces of the rail 21' and to which the horns 23, 23' or their holders 41 are connected. Operating the pantographic device thus moves all these horns except the centre one to new positions so that the mutual distances between the horns are proportionally changed. When influencing the pantographic device also the pins are moved in the grooves and the inverse process is also true.

The same adjustment procedure and the same mounting of the receiver horns as has been described above can be generally used for both lens antennas and paraboloid antennas and other amplifying/focusing antenna systems which can in some way be constructed to image a section of the geostationary path along a line in rotationally symmetric focus surface. The adjustment procedure can also approximately be used for for example a limited angular interval on an asymmetrical surface, in the case where a deviation from the focus surface does not too much affect the quality of the received signal.

If the antenna is not rotatable and only the receiver horns can be rotated it is necessary that the antenna somewhere has an approximately rotationally symmetric focus surface about which the group of receiver horns can be simultaneously rotated. However, if the whole antenna system is rotatable about its optical axis, this is not necessary.

Hereinabove a device intended for receiving signals has been described. However, the device can easily be modified for transmitting signals by replacing microwave horns for receiving to microwave horns for transmitting preserving the positions thereof, since ray paths are invertible according to physical laws.

What is claimed:

1. A device for receiving/transmitting electromagnetic signals from/to at least two satellites located in fixed points on the geostationary path, comprising:

an antenna for providing an image of a section of the geostationary path within which the satellites are located, at least two microwave horn for receiving/transmitting for receiving signals from and/or transmitting signals to the satellites, and a rail along which the microwave horns are placed, wherein the rail is rotatably mounted to the antenna to obtain an adjustable angular position about an axis with an adjustment movement in a plane perpendicular to the axis and that the rail comprises a fixed position for one of the microwave horns, this microwave horn placed with its receiving direction aligned with the axis and the other one/ones of the microwave horns adjustably placed at the rail at the side or sides of the fixedly positioned microwave horn.

2. A device according to claim 1, wherein the axis coincide with an axis of a focus surface of the antenna and/or with a symmetry axis of the antenna.

3. A device according to claim 1, wherein a mounting arm attached to the antenna, and a rotatable holder for the rail at the mounting arm, the rotatable holder allowing the adjustment movement of the rail in the plane perpendicular to the axis.

4. A device according to claim 3, wherein the mounting arm comprises a distant part having a surface facing the antenna and parallel thereto and that the rail comprises a projection, the holder being mounted to allow rotation between the projection and the surface.

5. A device according to claim 1, wherein the rail is of plastically deformable material, so that the rail manually can be given a selectable curved shape by bending the rail from an initially straight shape.

6. A device according to claim 1, wherein a first adjustment device for selectable bending of the rail from an initially straight shape.

7. A device according to claim 6, wherein the adjustment device comprises a stiff bar arranged in parallel to the rail and including an adjustment screw acting against the rail for bending it.

8. A device according to claim 6, wherein the adjustment device comprises an adjustable tensioning device acting with compressive forces in the longitudinal direction of the rail for bending the rail.

9. A device according to claim 6, wherein a second adjustment device comprising a pantographic device, to the inner joints of which the horns are attached for proportionally changing the distances between the horns at the same time when a bending of the rail is made in or for operating the first adjustment device.

10. A device according to claim 1, wherein an adjustment device comprising a pantographic device, at the inner joints of which the horns are attached for proportionally changing the distances between the horns.

11. A device according to claim 1, wherein holders for the horns allowing that the horns can be placed alternatingly in front of and behind a plane through the rail and thereby having their axes closer to each other than the width of the horns.

12. A device according to claim 1, wherein that the antenna comprises a lens of waveguide character.

13. A method of adjusting at least two transmitting or receiving horns in an antenna system for transmitting to or receiving from remotely located points placed on a line or curve so that the image of these points obtained by the antenna system is located on a focus line, wherein first a first horn is placed for receiving from a first point and that thereafter the group of remaining horns is rotated about the axis of the first horn which is simultaneously the receiving direction of the first horn.

14. A method according to claim 13, wherein that in placing the first horn the whole antenna system together with mounted horns are rotated, the axis of the first horn coinciding with the axis of the antenna system or with the symmetry axis of the focus surface of the antenna system.

15. A method according to claim 14, wherein that after the locking each of the remaining horns is displaced to positions corresponding to foci for corresponding ones of the points.

16. A method according to claim 13, wherein that when rotating the group of remaining horns it is rotated to a position in which one of these horns comes close to or in a focus corresponding to one of the points, whereafter the group is locked in this position.

17. A method according to claim 13, wherein that before placing the first horn the horns are arranged along a path given a curvature adjusted to the latitude at which the antenna is installed.

* * * * *